US010214895B2

(12) United States Patent
Song

(10) Patent No.: US 10,214,895 B2
(45) Date of Patent: Feb. 26, 2019

(54) BUILDING HAVING SECURITY AND SAFETY FUNCTION

(71) Applicant: Jong Woon Song, Gwangju (KR)

(72) Inventor: Jong Woon Song, Gwangju (KR)

( * ) Notice: Subject to any disclaimer, the term of this patent is extended or adjusted under 35 U.S.C. 154(b) by 17 days.

(21) Appl. No.: 15/537,921

(22) PCT Filed: Sep. 19, 2016

(86) PCT No.: PCT/KR2016/010431
§ 371 (c)(1),
(2) Date: Jun. 20, 2017

(87) PCT Pub. No.: WO2017/048108
PCT Pub. Date: Mar. 23, 2017

(65) Prior Publication Data

US 2018/0179752 A1 Jun. 28, 2018

(30) Foreign Application Priority Data

Sep. 16, 2015 (KR) ..... 10-2015-0130821

(51) Int. Cl.
*E04B 1/343* (2006.01)
*E06B 3/48* (2006.01)
(Continued)

(52) U.S. Cl.
CPC ..... *E04B 1/34336* (2013.01); *E04B 1/343* (2013.01); *E04B 1/7612* (2013.01);
(Continued)

(58) Field of Classification Search
CPC .... E04B 1/003; E04B 1/0046; E04B 1/34336; E04B 1/7069; E04B 1/7076;
(Continued)

(56) References Cited

U.S. PATENT DOCUMENTS 2,955,549 A * 10/1960 Frankfort ..... E04H 9/12 109/1 S
3,534,512 A * 10/1970 Ballas ..... E04B 1/3445 135/115
(Continued)

FOREIGN PATENT DOCUMENTS

KR 20-0308714 3/2003
KR 10-2004-0096851 11/2004
(Continued)

*Primary Examiner* — Ryan D Kwiecinski
*Assistant Examiner* — Matthew J Gitlin
(74) *Attorney, Agent, or Firm* — Lex IP Meister, PLLC

(57) ABSTRACT

A building having a security and safety function of the present invention may include: a house body that is configured to include an inner panel that defines an interior space, an outer panel that surrounds the inner panel to be spaced a predetermined distance from the outer surface of the inner panel, a heat insulating material that is installed between the inner panel and the outer panel, and an air flow passage that is formed between the inner panel and the outer panel to facilitate a fluid flow therebetween and to block the heat transfer with respect to the outside; an indoor entrance door configured to be installed on one side of the house body for entering the interior space; and an outdoor entrance door configured to be installed on the house body in front of the indoor entrance door. The building can control the entry of children or outsides into the rooftop of the building without permission from the user in order to thereby prevent safety accidents and in order to thereby improve a security function.

2 Claims, 5 Drawing Sheets

(51) Int. Cl.

| | |
|---|---|
| ***E06B 5/11*** | (2006.01) |
| ***E06C 9/00*** | (2006.01) |
| ***E04B 1/76*** | (2006.01) |
| ***E06B 3/70*** | (2006.01) |
| ***E06C 9/04*** | (2006.01) |
| ***E04H 1/12*** | (2006.01) |

(52) U.S. Cl.
CPC ..... *E04H 1/1205* (2013.01); *E06B 3/48* (2013.01); *E06B 3/7003* (2013.01); *E06B 5/11* (2013.01); *E06C 9/00* (2013.01); *E06C 9/04* (2013.01); *E06B 3/481* (2013.01)

(58) Field of Classification Search
CPC ..... E04B 1/7612; E06C 9/04; E06B 3/7003; E06B 3/481; E04H 2001/1283; E04H 9/10; E04H 9/12; E04H 9/14; E04H 9/16
USPC ..... 52/19, 71, 79.1, 79.6; 182/77, 93; 49/36, 68, 61
See application file for complete search history.

(56) References Cited

U.S. PATENT DOCUMENTS 4,057,936 A * 11/1977 Wyatt, Jr. ..... E06B 3/00 454/224
4,282,689 A * 8/1981 Royer ..... E04B 1/76 49/40
4,478,001 A * 10/1984 Hogan ..... B60J 5/0497 135/93
4,669,240 A * 6/1987 Amormino ..... E04B 1/04 264/253
5,768,829 A * 6/1998 Thompson ..... E04B 1/34321 52/86
5,832,676 A * 11/1998 Gillmore ..... E04B 1/3431 52/67
6,385,919 B1 * 5/2002 McCarthy ..... E04H 9/12 52/169.6
6,385,920 B1 * 5/2002 Chandler ..... E04H 9/12 52/169.6
8,966,832 B1 * 3/2015 Scott, IV ..... E04H 9/14 135/118
2003/0009954 A1 * 1/2003 Bradley ..... E04H 1/1205 52/79.1
2005/0193643 A1 * 9/2005 Pettus ..... B01L 99/00 52/79.1

FOREIGN PATENT DOCUMENTS

KR 10-2010-0061899 6/2010
KR 10-1383889 4/2014
KR 10-1421471 7/2014
WO WO-2016039627 A1 * 3/2016 ..... E06B 7/08

* cited by examiner

BUILDING HAVING SECURITY AND SAFETY FUNCTION

TECHNICAL FIELD

The present invention relates to a building having a security and safety function, and more specifically, further relates to a building having a security and safety function, which can: be installed and used in regions of beautiful scenery, resorts, or construction sites; improve the heat insulation property and a security function; and increase the space usability according to the installation of a folding outdoor entrance door and a ladder to go up to the rooftop.

BACKGROUND ART

In general, a prefabricated building or a factory-fabricated building, which is a kind of building, may be used by using panels or light construction materials while being simply moved, and has been developed and provided in a variety of forms and structures according to the purpose of usage, such as a suburban house, a camping house, a bungalow, or a movable house. Such a building may be easily installed and used in the places, such as regions of beautiful scenery, resorts, or construction sites. The buildings adopt cooling/heating equipment that is installed therein in order to provide the convenience of usage.

Korea Patent Publication No. 2010-0061899 discloses an environment-friendly simple movable house. The floor of the disclosed movable house is configured with a non-toxic waterproof mortar layer in which reinforcing bars are embedded, Styrofoam, a non-toxic waterproof concrete layer, and a loess layer of which the front and back surfaces are covered with meshes in sequence as it goes from the outer side to the inner side thereof, and the wall of the house body is configured with Styrofoam of which the front and back surfaces are coated with a flame retardant, and a non-toxic waterproof mortar layer in which reinforcing bars are embedded, a loess layer of which the front and back surfaces are covered with meshes, a paint layer that is mixed with the loess layer, a Korean paper layer, and silver nano-water, which are formed in sequence on the inner side of the Styrofoam.

Korean Patent No. 1383889 discloses a container house that is applied with a stand-alone solar power system.

In order to increase the usability of the rooftop of the prefabricated building, it is essential to install separate means for people to go up to the rooftop. A general ladder is used for the means for people to go up to the rooftop. However, in the case where the ladder is installed indoors, there is a problem that the space usability is relatively reduced. On the contrary, in the case where the ladder is installed outdoors, it causes a trespassing and poses a risk of safety accidents because children can easily go up through the same.

In particular, the conventional prefabricated buildings have relatively poor heat-insulation and cooling/heating efficiencies, and thus, in order to improve this, the present inventor was granted Korean Patent No. 10-1421471 regarding a simple house having a multi-function, which can: reduce management costs with the seasons; increase the durability; and be simply used for a variety of purposes according to installed places. The present invention has been developed and filed by associating a ladder to go up to the rooftop of a simple house with a door.

DETAILED DESCRIPTION OF THE INVENTION

Technical Problem

An objective of the present invention is to provide a building having a security and safety function, which can minimize an installation space when installing a ladder to go up to the rooftop from the inside of the entrance, and can improve a security function by preventing outsiders from going up to the rooftop without permission.

Another objective of the present invention is to provide a building having a security and safety function, which can: improve the heat insulation property of a house body; secure an indoor space in the case where an outdoor entrance door is open; prevent safety accidents caused by children who use a ladder by disabling the use of the ladder; and esthetically enhance the exterior of the building by combining the ladder with the outdoor entrance door.

Technical Solution

A building having a security and safety function of the present invention to solve the technical problem may include: a house body that is configured to include an inner panel that defines an interior space, an outer panel that surrounds the inner panel to be spaced a predetermined distance from the outer surface of the inner panel, a heat insulating material that is installed between the inner panel and the outer panel, and an air flow passage that is formed between the inner panel and the outer panel to facilitate a fluid flow therebetween and to block the heat transfer with respect to the outside; an indoor entrance door that is configured to be installed on one side of the house body for entering the interior space; and an outdoor entrance door that is configured to be installed on the house body in front of the indoor entrance door.

In the present invention, a ladder is installed on the side wall between the indoor entrance door and the outdoor entrance door, which includes foot step members that are installed to be spaced a predetermined distance from each other to go up to the rooftop, and a plurality of guide holes are formed on the outdoor entrance door such that the foot step members are exposed to the outside of the outdoor entrance door when the outdoor entrance door is opened inwards and comes into contact with the side wall.

The outdoor entrance door is configured to be split into two sides to be folded, and a plurality of guide holes are vertically formed at a constant interval on the split sides.

The foot step members constituting the ladder protrude from the guide holes, and are formed to have a smaller diameter than the width of the guide hole.

Effects of the Invention

The building having a security and safety function, according to the present invention, is configured to have an air flow passage that is formed between an inner panel that encloses an interior space and an outer panel to facilitate the flow of air caused by the heating of the outer panel in order to thereby circulate the internal air or discharge the internal air to the outside and in order to thereby prevent the heat or the cold of the outside from being directly transferred to the interior space. In addition, since a folding outdoor entrance door is installed at the entrance of the building and a ladder to go up to the rooftop of the building is installed therein, it is possible to prevent children from going up to the rooftop of the building without guardians so that safety accidents can be prevented, and it is possible to prevent outsiders from entering the rooftop of the building without permission from the user so that a security function can be enhanced.

Furthermore, the outdoor entrance door is folded and opened so that foot step members of the ladder are inserted into guide holes to then share the installation space of the ladder and the folding space of the outdoor entrance door and to further secure an interior space. In addition, since the ladder is installed indoors, the exterior of the building is easy on the eye and a graceful interior can be constructed. Furthermore, since the ladder to enter the rooftop is installed in a space between the indoor entrance door and the outdoor entrance door, it is possible to reduce the heat loss of the interior.

MODE FOR CARRYING OUT THE INVENTION

Figure 1:
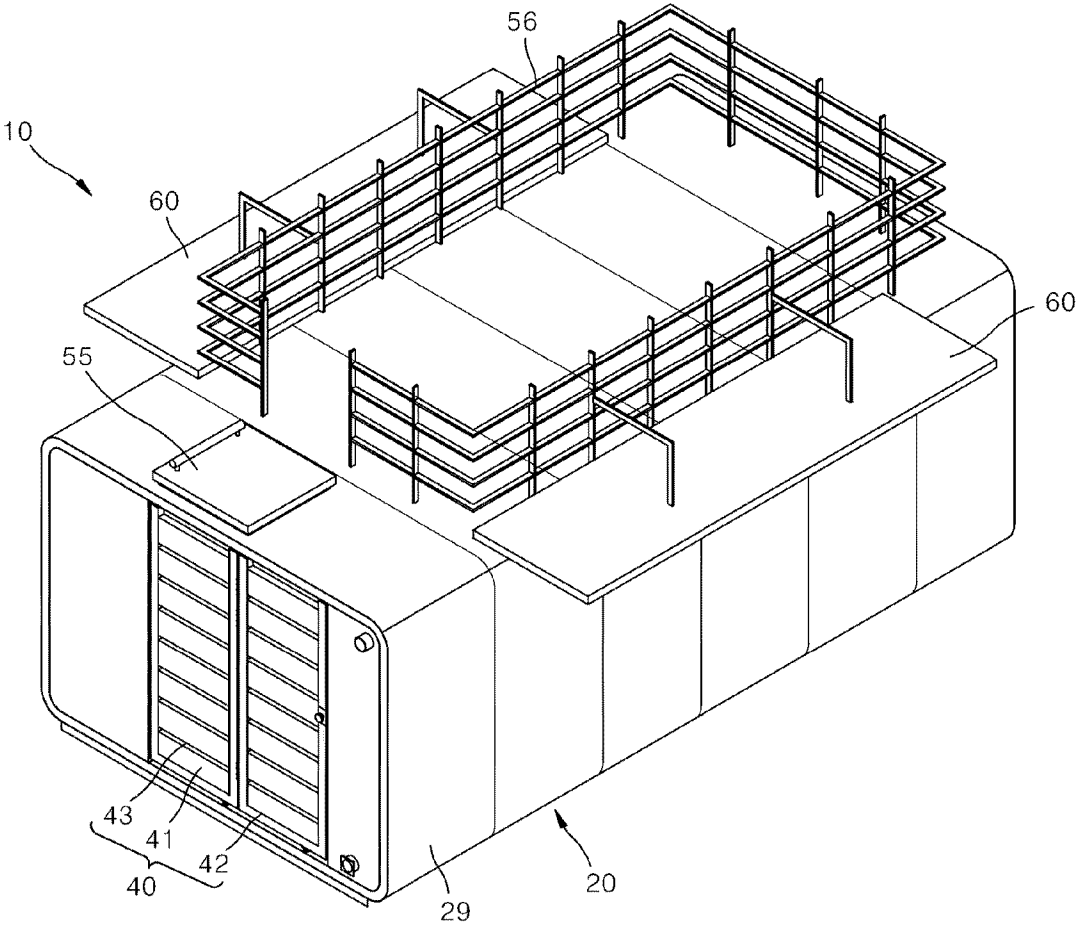
FIG. 1 is a perspective view of a building having a security and safety function, according to the present invention.

A building having a security and safety function, according to the present invention, can: increase the heat insulation effect between the outside and the inside; reduce an installation space of a ladder; and maximize a security effect, of which the embodiments will be illustrated in FIGS. 1 to 5.

Referring to the drawings, the building 10 having a security and safety function, according to the present invention, adopts a house body 20 that is configured with a wall panel 29 that includes: an inner panel 21 that defines an interior space; an outer panel 22 that surrounds the inner panel 21 to be spaced a predetermined distance from the outer surface of the inner panel 21; a heat insulating material 23 that is installed between the inner panel 21 and the outer panel 22; and an air flow passage 24 that is formed between the inner panel 21 and the outer panel 22 to supply a cold air or warm air, and to facilitate a fluid flow therebetween in order to thereby block the heat transfer between the interior space and the outside. In addition, an indoor entrance door 30 for entering the interior space is installed on one side of the house body 20, and an outdoor entrance door 40 is installed on the house body 20 in front of the indoor entrance door 30. When the outdoor entrance door 40 is closed, the interior space may be extended to a space between the indoor entrance door 30 and the outdoor entrance door 40 to be separated from the outside. The outdoor entrance door 40 may be configured as a folding door that has two unit doors 41 and 42 that are folded, and the outdoor entrance door 40 has guide holes 43 formed thereon to be combined with foot step members 51 of a ladder, which will be described later. A ladder 50 is installed on the side wall 26 between the indoor entrance door 30 and the outdoor entrance door 40, which has foot step members 51 that are installed at a predetermined interval to go up to the rooftop, and a ceiling door 55 to go up to the rooftop is installed on the ceiling corresponding to the ladder 50.

The building having a security and safety function, according to the present invention, which is configured as described above, will be described in more detail for each element.

In the house body 20 of the building 10 having a security and safety function, according to the present invention, the wall 29 is comprised of the inner panel 21 and the outer panel 22, and the heat insulating material 23 is installed between the same, wherein the outer panel 22 or the inner panel 21 may be made of a metal plate. Although the heat insulating material 23 may be formed of EPDM, the heat insulating material, i.e., a heat reserving material, is not limited thereto, and it may be made of a variety of materials. In addition, the air flow passage 24 is installed between the inner panel 21 and the outer panel 22, and more preferably, the air flow passage 24 is installed in the wall 29 of the house body 20, that is, in the side wall, ceiling, and floor. However, the air flow passage 24 is not limited thereto, and may be formed in a partitioned state.

Figure 3:
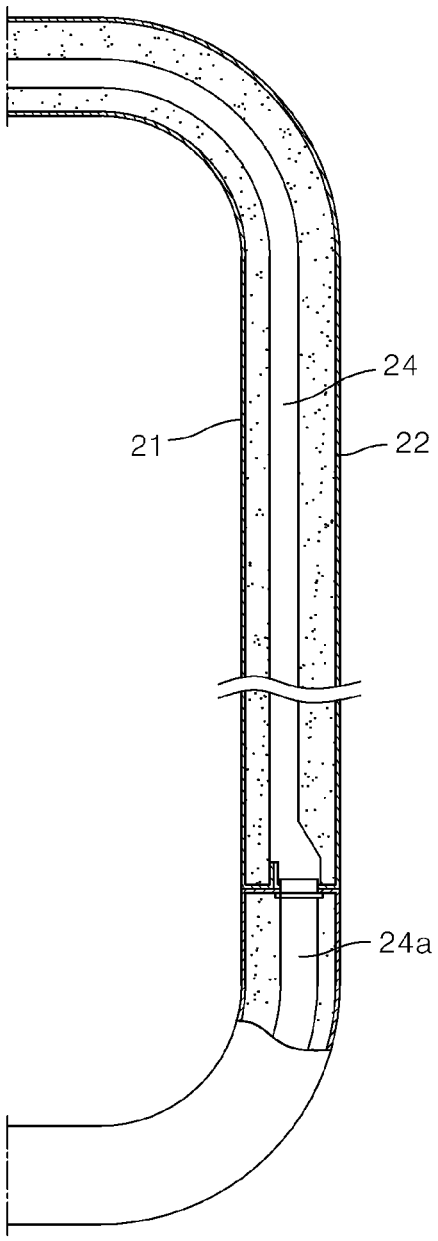
FIG. 3 is a partially cut-away cross-sectional view of a house body.

The air flow passage 24, which is formed between the outer panel 22 and the inner panel 21, may be connected to a blower by an air hose 24*a* in order to supply the air in the interior space to then circulate or flow as shown in FIG. 3. However, the present invention is not limited thereto, and a waste heat that is generated from a heat pump, an air conditioning system, an incinerator, or camping equipment for cooling or heating the interior space may be utilized as the cold air or warm air through the air hose.

In the process of circulating air through the air flow passage 24 by the blower, when the outside temperature is high as in summer, the indoor air that is discharged from the interior space to the outside is circulated through the air flow passage 24 in order to thereby cool the space of the wall 29. Therefore, the heat may be prevented from being transferred from the outside to the inside. In addition, when the outside temperature is low as in winter, since the indoor air that is discharged to the outside is circulated through the air flow passage 24 to then heat the space of the wall 29, the cold may be prevented from being transferred from the outside to the inside in order to thereby improve the heating efficiency.

In addition, in order to improve the heat insulation efficiency and the thermal conductivity, a heat-reflector sheet may be attached to the inner surface of the inner panel 21. It is preferable to attach the heat insulating material to the inner surface of the outer panel 22 in order to thereby prevent condensation.

Figure 2:
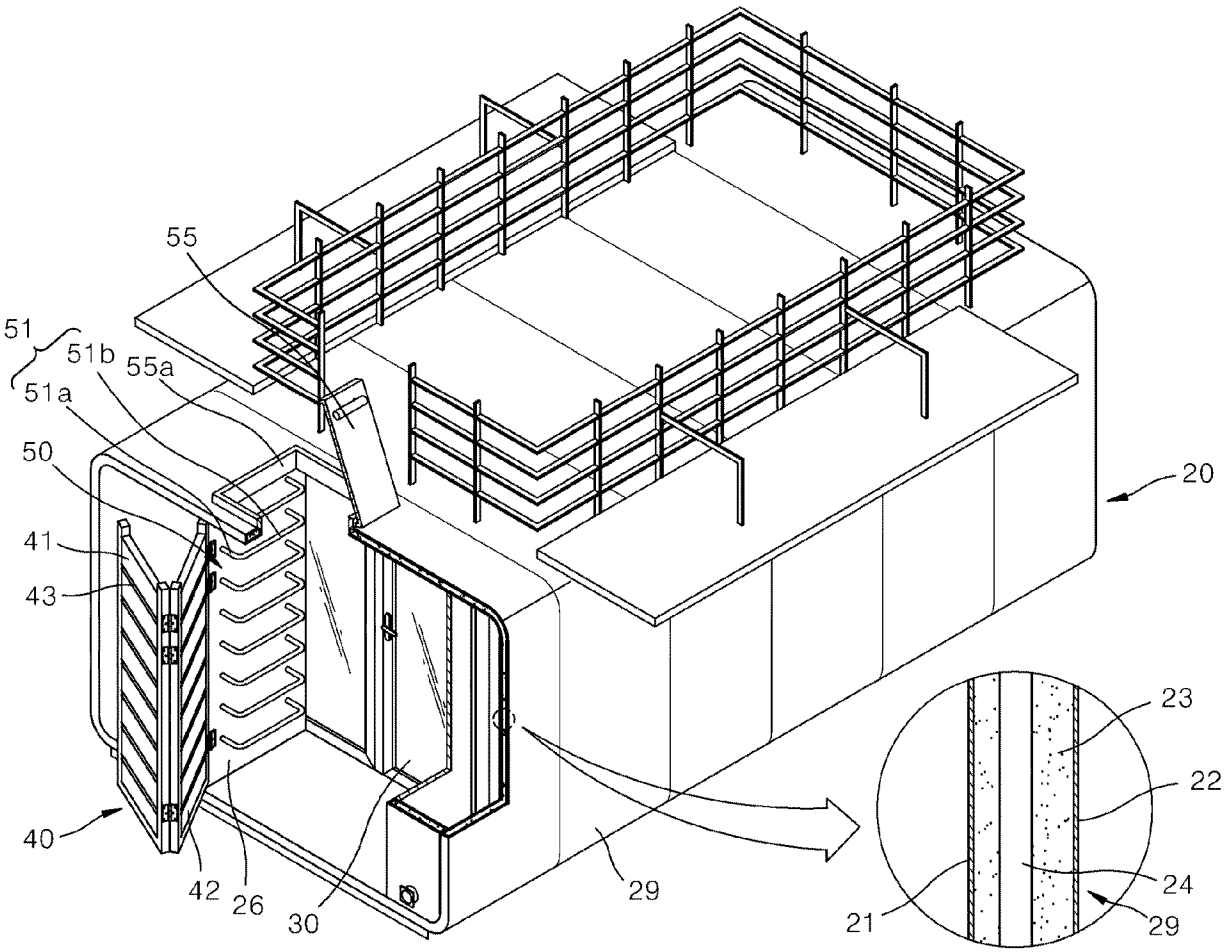
FIG. 2 is a partially cut-away perspective view showing the state in which an outdoor entrance door and a ladder are installed in a building having a security and safety function, according to the present invention.

Meanwhile, as shown in FIGS. 1 and 2, railings 56 are installed at the edge of the rooftop of the house body 20 in order to prevent fall accidents, and awnings 60 are installed on both sides of the building in which the entrance or windows are positioned. In addition, although it is not shown in the drawings, cooling/heating equipment is installed to cool or heat the interior space.

The ladder 50 adopts the foot step members 51 that are installed on the side wall 26 between the indoor entrance door 30 and the outdoor entrance door 40, and the foot step members 51 are configured to have support portions 51*a* that protrude from the wall 29 and horizontal portions 51*b* that connect the support portions 51*a*. Here, the foot step members 51 may be formed of bent pipes, and may have a variety of colors in consideration of design when they are combined with the guide holes 43 that are formed on the outdoor entrance door 40. The guide holes 43 are formed on the positions corresponding to the foot step members such that the foot step members 51 are able to be combined with the same while the outdoor entrance door 40 is open.

The foot step members 51 and the guide holes 43 that are formed to pass through the outdoor entrance door 40 may be designed to have various shapes according to the structure and shape of the outdoor entrance door 40. For example, they may be formed in a wave shape or in a V-shape.

In the case where the outdoor entrance door 40 is a folding door that is comprised of two unit doors 41 and 42 that can be folded, a guide rail or caster may be installed in the upper or lower side in order for the door to be effectively opened and closed.

Meanwhile, the ceiling door 55 that is installed on the ceiling corresponding to the ladder has a structure of opening and closing an upper hole 55*a* that is formed on the ceiling through which the user goes up to the rooftop, wherein the user may go up by using the ladder 50 and may open the ceiling door 55 of the upper hole 55*a* to then reach the rooftop.

The building 10 having a security and safety function, according to the present invention, which is configured as described above, may maximize the heat insulation effect because the air flow passage 24 is formed in the wall as described above. In addition, since the ladder 50 for the user to go up to the rooftop of the house body 20 is installed inside the outdoor entrance door 40, it is possible to prevent outsiders from trespassing on the building without permission from the user, as well as to prevent children from going up to the rooftop without guardians in the outside of the house body 20, in order to thereby prevent safety accidents and in order to thereby improve the security function.

Figure 4:
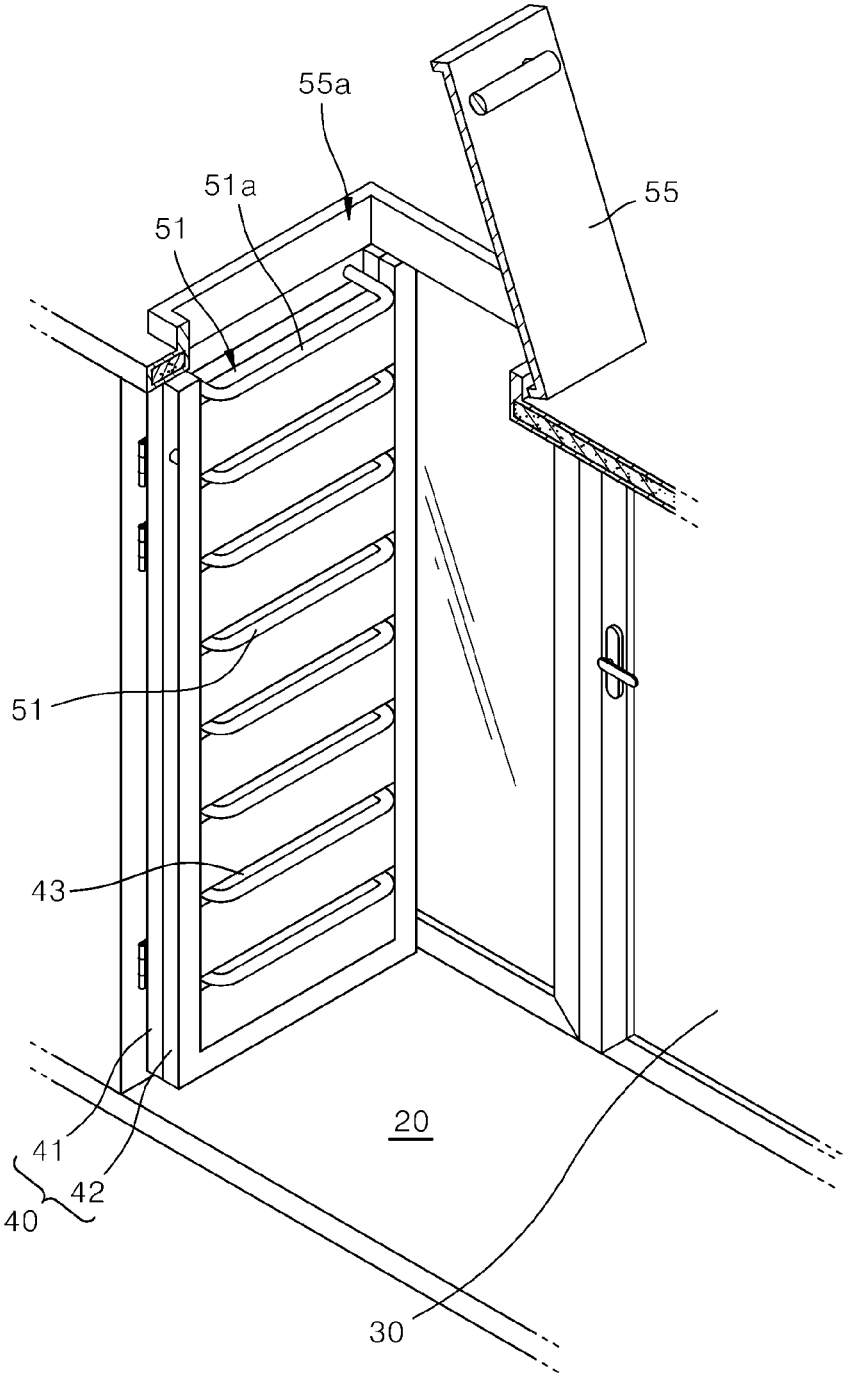
FIG. 4 is a partially cut-away perspective view showing the state in which the outdoor entrance door is combined with the ladder.
Figure 5:
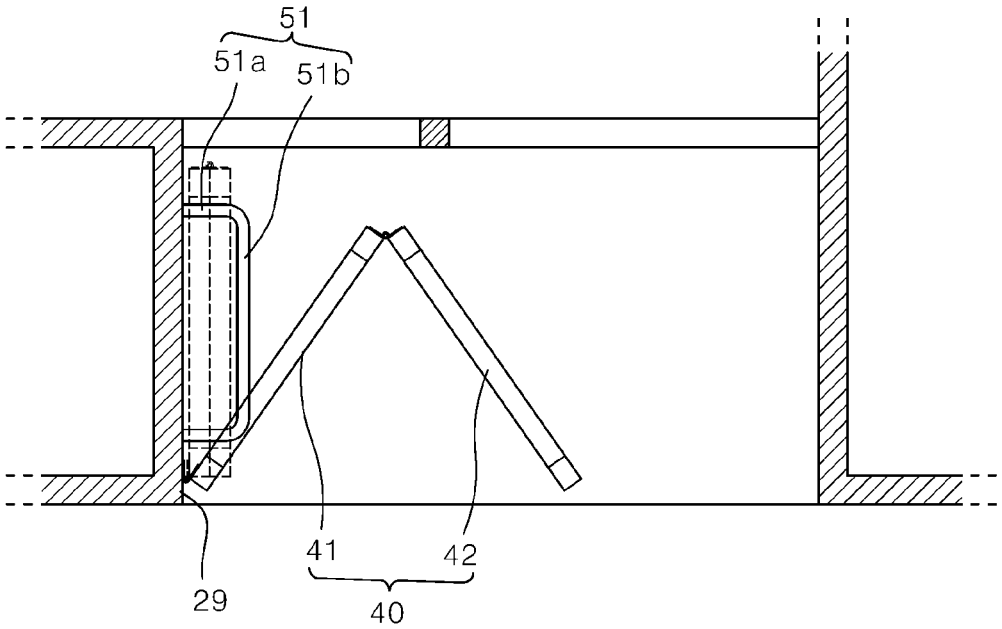
FIG. 5 is a cross-sectional view showing the state in which the outdoor entrance door is combined with the ladder.

In addition, the building having a security and safety function, as shown in FIGS. 4 and 5, may allow the foot step members 51 of the ladder 50 to be combined with the guide holes 43 when the outdoor entrance door 40 is open, thereby reducing a loss space caused by the installation of the ladder 50. That is, when the user open the outdoor entrance door 40 by folding the same toward one side, the outdoor entrance door 40 comes into contact with the ladder 50 while the respective foot step members 51 of the ladder 50 are inserted into the guide holes 43 so that the outdoor entrance door 40 can be completely opened while being folded.

Therefore, since the installation space of the ladder 50 and the interior space required for the folding outdoor entrance door 40 are commonly shared, it is possible to secure an interior space. In addition, the appearance of the outdoor entrance door 40 can be esthetically improved by combining the outdoor entrance door 40 with the ladder. Furthermore, since the indoor entrance door 30 is installed inside the outdoor entrance door 40 and the ladder for the user to go up to the rooftop of the building is installed between the outdoor entrance door 40 and the indoor entrance door 30, an excellent security function can be secured.

Although the present invention has been described with reference to the embodiments illustrated in the drawings, they are only examples, and those of ordinary skill in the art shall understand that various modifications and equivalents may be provided based on the same.

Therefore, the true technical protection scope of the present invention will be construed by the technical spirit of the appended claims.

The invention claimed is:

1. A building having a security and safety function, the building comprising:

a house body including an inner panel that defines an interior space, an outer panel that surrounds the inner panel to be spaced a predetermined distance from the outer surface of the inner panel, a heat insulating material that is installed between the inner panel and the outer panel, and an air flow passage that is formed between the inner panel and the outer panel to facilitate a fluid flow therebetween and to block the heat transfer with respect to the outside;

an indoor entrance door installed on one side of the house body for entering the interior space; and an outdoor entrance door installed on the house body in front of the indoor entrance door, wherein a ladder is installed on a side wall between the indoor entrance door and the outdoor entrance door, which includes foot step members that are installed to be spaced a predetermined distance from each other to go up to a rooftop, and wherein a plurality of guide holes are formed on the outdoor entrance door such that the foot step members are exposed to the outside of the outdoor entrance door when the outdoor entrance door is opened inwards and comes into contact with the side wall.

2. The building according to claim 1, wherein the foot step members of the ladder are arranged to correspond to positions of the guide holes that are formed on the outdoor entrance door, and each foot step member of the ladder has a smaller width and diameter than a size of a corresponding guide hole.

* * * * *